US010130167B1

(12) United States Patent
Tao

(10) Patent No.: US 10,130,167 B1
(45) Date of Patent: Nov. 20, 2018

(54) FOLDABLE TABLE

(71) Applicant: Xiumao Tao, Beijing (CN)

(72) Inventor: Xiumao Tao, Beijing (CN)

( * ) Notice: Subject to any disclaimer, the term of this patent is extended or adjusted under 35 U.S.C. 154(b) by 0 days.

(21) Appl. No.: 16/055,140

(22) Filed: Aug. 5, 2018

Related U.S. Application Data

(62) Division of application No. 15/294,739, filed on Oct. 16, 2016, now Pat. No. 10,070,718.

(30) Foreign Application Priority Data

Nov. 16, 2015 (CN) ..... 2015 2 0907756 U
Nov. 16, 2015 (CN) ..... 2015 2 0907759 U

(51) Int. Cl.
*A47B 13/08* (2006.01)
*A47B 3/00* (2006.01)
*A47B 3/08* (2006.01)

(52) U.S. Cl.
CPC ..... *A47B 13/088* (2013.01); *A47B 3/002* (2013.01); *A47B 3/0803* (2013.01); *A47B 2003/0806* (2013.01)

(58) Field of Classification Search
CPC ..... A47B 3/0806; A47B 3/083; A47B 3/0835; A47B 3/087; A47B 3/0803; A47B 3/002; A47B 2003/0806; A47B 2003/145
See application file for complete search history.

(56) References Cited

U.S. PATENT DOCUMENTS 56,769 A * 7/1866 Loth ..... A47B 3/083 108/173
726,787 A * 4/1903 Turner ..... A47B 3/083 108/173
927,773 A * 7/1909 Buel ..... A47B 3/083 108/173
1,339,389 A * 5/1920 Havens, Sr. ..... A47B 3/083 108/79
2,654,647 A * 10/1953 Murray ..... A47B 3/083 108/173
2,791,477 A * 5/1957 Wesbecher ..... A47B 3/0803 108/11
2,934,386 A * 4/1960 Shore ..... A47B 3/087 108/35
3,108,550 A * 10/1963 Knoblock ..... A47B 3/0803 108/124
3,303,797 A * 2/1967 Mueller ..... A47B 3/083 108/173
3,379,145 A * 4/1968 Lieberman ..... A47B 3/00 108/166
3,954,068 A * 5/1976 Roberts ..... A47B 3/0918 105/124
4,809,619 A * 3/1989 Piretti ..... A47B 3/00 108/115
4,825,781 A * 5/1989 Palmer ..... A47B 3/06 108/115

(Continued)

*Primary Examiner* — Hanh V Tran
(74) *Attorney, Agent, or Firm* — Yong Chen

(57) ABSTRACT

A foldable table having a deployment condition and a folded condition. The table includes a tabletop consisting of three equal-sized sectors, where the first and second sectors, the second and third sectors are rotatably joined together along adjacent side edges. Each leg support includes a depressed area configured to accommodate a portion of a respective sector and engage a side edge of the sector when the table is in the folded condition.

4 Claims, 14 Drawing Sheets

(56) References Cited

U.S. PATENT DOCUMENTS

| | | | | | |
|---|---|---|---|---|---|
| 5,088,419 | A * | 2/1992 | Hartwell | A47B 3/083 | 108/166 |
| 5,156,095 | A * | 10/1992 | Hansbaek | A47B 1/03 | 108/66 |
| 9,526,328 | B2 * | 12/2016 | Illulian | A47B 3/06 | |
| 2009/0000522 | A1 * | 1/2009 | Collins | A47B 3/087 | 108/12 |
| 2014/0190371 | A1 * | 7/2014 | Woog | A47B 3/0912 | 108/36 |

* cited by examiner

FOLDABLE TABLE

CROSS REFERENCE TO RELATED APPLICATIONS

This application is a divisional application of U.S. non-provisional patent application Ser. No. 15/294,739, filed Oct. 16, 2016, which claims priority to Chinese Application Nos. 201520907756.4 and 201520907759.8, both filed Nov. 16, 2015. The disclosure of each of these prior-filed applications is incorporated herein by reference in its entirety.

TECHNICAL FIELD

The present invention relates to a foldable table, and more particularly, to a foldable table with a round tabletop when the table is in being used, and a compact, stacked configuration when the table is folded for storage.

BACKGROUND

Currently common desks and tables used in everyday life are one-piece or assembled from many parts. However, one piece desks and tables that do not require assembly take up significant storage space and are difficult to transport. Assembling the parts for desks or tables at one's home or business premise can be complex and time-consuming, and it is usually very difficult to disassemble these structures once assembled.

There are certain foldable tables on the market. One type of such foldable tables include a tabletop and legs that are rotatable relative to the tabletop. When a user wants to use the table, he/she turns the table legs and lay the tabletop in the horizontal direction. When the user finishes using the table, he/she rotates and folds the table legs. In the folded configuration, the tabletop and the table legs are substantially parallel. This type of foldable table is convenient, but still has some drawbacks. For example, the tabletop has a large surface which requires a large tablecloth to keep it clean. Sometimes for the purpose of increasing usable surface of the tabletop, four pieces of foldable extensions are included on the side edges of the tabletop. This would increase the cost and weight of the table.

The present inventor previously invented a foldable table to resolve the above problems. The table includes a round tabletop consisting of three even-sized sectors which can be folded into a stacked configuration. However, in the folded configuration, the legs of the table are exposed and can be easily damaged in handling. Also, the table is still quite bulky when folded.

Thus, there is a need for improved designs of a foldable table which can be folded into smaller and more compact configuration.

SUMMARY OF THE INVENTION

In one aspect of the present invention, a foldable table having a deployment condition and a folded condition is provided. The table includes a tabletop having an upper side and an underside. The tabletop consists of three equal-sized sectors, each sector including two side edges and a periphery, and a groove along the periphery of the sector on the underside. The first sector and the second sector are rotatably connected at the two adjacent edges between the first sector and the second sector. The second sector and the third sector are rotatably connected at the two adjacent edges between the second sector and the third sector. The three sectors form a round flat tabletop surface when the table is in the deployment condition, and form a stacked configuration when the table is in the folded condition. The table further includes a leg support for each of the sectors. Each leg support includes an outer leg component having an upper end hingedly joined with a respective sector at the groove of the sector. The outer leg component includes an upper arcuate portion which is dimensioned and shaped to be accommodated at least partially into the groove when the table is in the folded condition.

In some embodiments, the first sector and the second sector are rotatable in a first direction, the second sector and the third sector are rotatable in a second, opposite direction, such that when the table is in the folded condition, the second sector is stacked between the first sector and the third sector.

In some embodiments, the foldable table further includes a curved bar shaped and dimensioned to be inserted into and spanning the grooves of two adjacent sectors when the table is in the deployment condition.

In some embodiments, the foldable table further includes a latch mechanism, the latch mechanism being configured to couple adjacent edges between two sectors when the table is in the deployment condition.

In some embodiments, each of the leg supports further comprises an inner leg component, the inner leg component and the outer leg component of each leg support being linked by at least one connecting member.

In some embodiments, the inner leg component and the outer leg component of each leg support are substantially in a same plane, wherein each outer leg component further comprises a lower portion which splays downward.

In some embodiments, the foldable table further includes a reinforcing brace having a first end and a second end, the first end connected to a bracket engaged with an inner leg component of a leg support of a sector, and the second end connected to an edge of the sector.

In another aspect, the present invention provides a foldable table of an alternative design. The foldable table has a deployment condition and a folded condition. It includes a tabletop consisting of three equal-sized sectors. Each sector has an upper side and an underside, and includes two side edges. The first sector and the second sector are rotatably connected at the two adjacent side edges between the first sector and the second sector. The second sector and the third sector are rotatably connected at the two adjacent edges between the second sector and the third sector, whereby the three sectors form a round flat tabletop surface when the table is in the deployment condition, and form a stacked configuration when the table is in the folded condition. The table further includes three leg supports, each associated with one of the three sectors, respectively. Each leg support takes a generally planar profile and can include a shoulder portion having a top edge hingedly connected to the underside of the associated sector to allow rotation of the sector about the top edge. At least one leg support has a depressed area configured to accommodate a portion of the associated sector when the table is in the folded condition.

In some embodiments of the foldable table of this alternative design, the depressed area includes a slanted step configured to engage a side edge of the associated sector when the table is in the folded condition.

In some embodiments of the foldable table of this alternative design, the first sector and the second sector are rotatable in a first direction, the second sector and the third sector are rotatably in a second, opposite direction, such that when the table is in the folded condition, the second sector is stacked between the first sector and the third sector.

In some embodiments of the foldable table of this alternative design, the leg support for the first sector is hingedly connected to the leg support for the second sector, the leg support for the second sector is hingedly connected to the leg support for the third sector, and wherein when the table is in the folded condition, the leg support for the second sector is stacked between the leg support for the first sector and the leg support for the third sector.

DETAILED DESCRIPTION

Figure 1A:
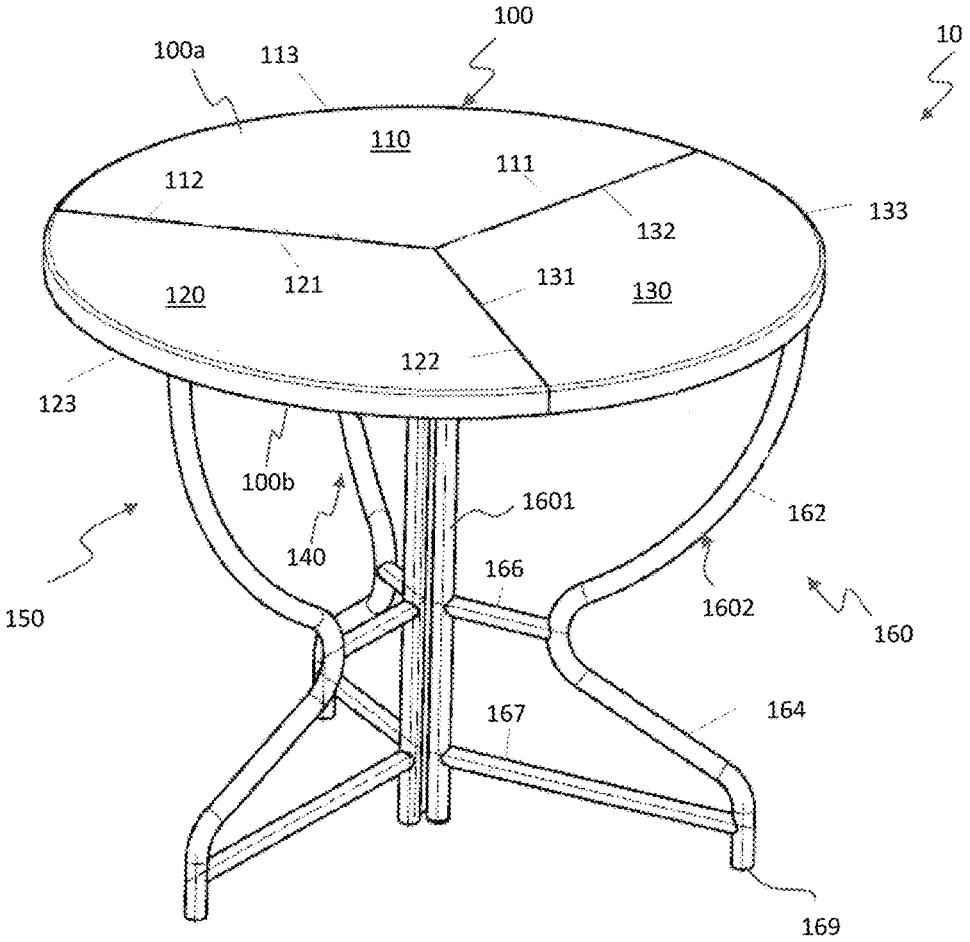
FIG. 1A is a perspective view of a table in a deployment condition according to some embodiments of the present invention.

Generally, the present disclosure provides a foldable table. The table has a deployment (or expanded) condition when it is being used for its intended purpose. When not in use, the table can be folded into a storage (or folded) condition. In the folded condition, the table takes a very compact form and multiple tables can be easily stacked together.

FIGS. 1A, 1B, 2A, 2B, 3-6 illustrate certain embodiments of a first design of the foldable table of the present invention in different states, where like reference numerals denote like elements. Table 10 includes a tabletop 100 which has an upper side 110*a* and an underside 110*b*, and consists of three equal-sized sectors 110, 120, and 130. Each of the tabletop sectors 110, 120, and 130 includes two side edges: (111, 112), (121, 122), (131, 132), respectively, and a periphery 113, 123, and 133, respectively.

Further, each sector includes a groove along the periphery of the sector on the underside. For example, and as shown in FIG. 4, each of the sectors 110, 120, 130 has a groove 115, 125, 135.

The first sector 110 and the second sector 120 are rotatably connected at two adjacent edges 112 and 121 between the first sector and the second sector. The second sector 120 and the third sector 130 are rotatably connected at two adjacent edges 122 and 131 between the second sector and the third sector. The edges 132 and 121 are not connected and referred also as the free side edges. The three sectors 110, 120, 130 together form a round flat tabletop surface when the table is in the deployment condition (as shown in FIG. 1A), and form a stacked configuration when the table is in the folded condition, as shown in FIG. 2A.

The sectors 110, 120, 130 of table 10 each also has a leg support 140, 150, 160, respectively. Each of the leg supports includes an outer leg component and an inner leg component, with the outer leg component hingedly joined with a respective sector at the groove of the sector, and includes an upper arcuate portion which is dimensioned and shaped to be accommodated at least partially into the groove when the table is in the folded condition. The outer leg components and the inner leg components can be made of a metal, such as stainless steel, cast iron, etc., or other materials as desired. Using leg support 160 as an example, and referring to FIGS. 1A, 1B, 2B, leg support 160 has an inner leg component 1601 and an outer leg component 1602. The outer leg component 1602 includes an upper arcuate portion 162, and an upper end 161 joined with the groove 135 of sector 130 (at location 161*a*, shown in FIGS. 2B and 4), which can be approximately in the middle of the periphery 133. The joining can be accomplished by screw or bolt, or other techniques commonly known in the art. As shown in FIG. 1B, outer leg component 1602 can rotate relative to sector 130 about axis L1; similarly, inner leg component 1601 can also be joined with the sector 130 and rotate relative to sector 130 about axis L2, which is parallel to L1. As shown in FIG. 2B, when the table is in the storage condition, the upper arcuate portion 162 of the outer leg component 1602 is tucked into the groove 135 of sector 130. The width Wg and depth Dg of the groove can be varied as desired or need. When the depth Dg is sufficient and the width Wg is greater than the diameter DL of the arcuate portion 162 of the outer leg component 1602, the arcuate portion 162 can be completely accommodated into the groove 135.

Figure 2A:
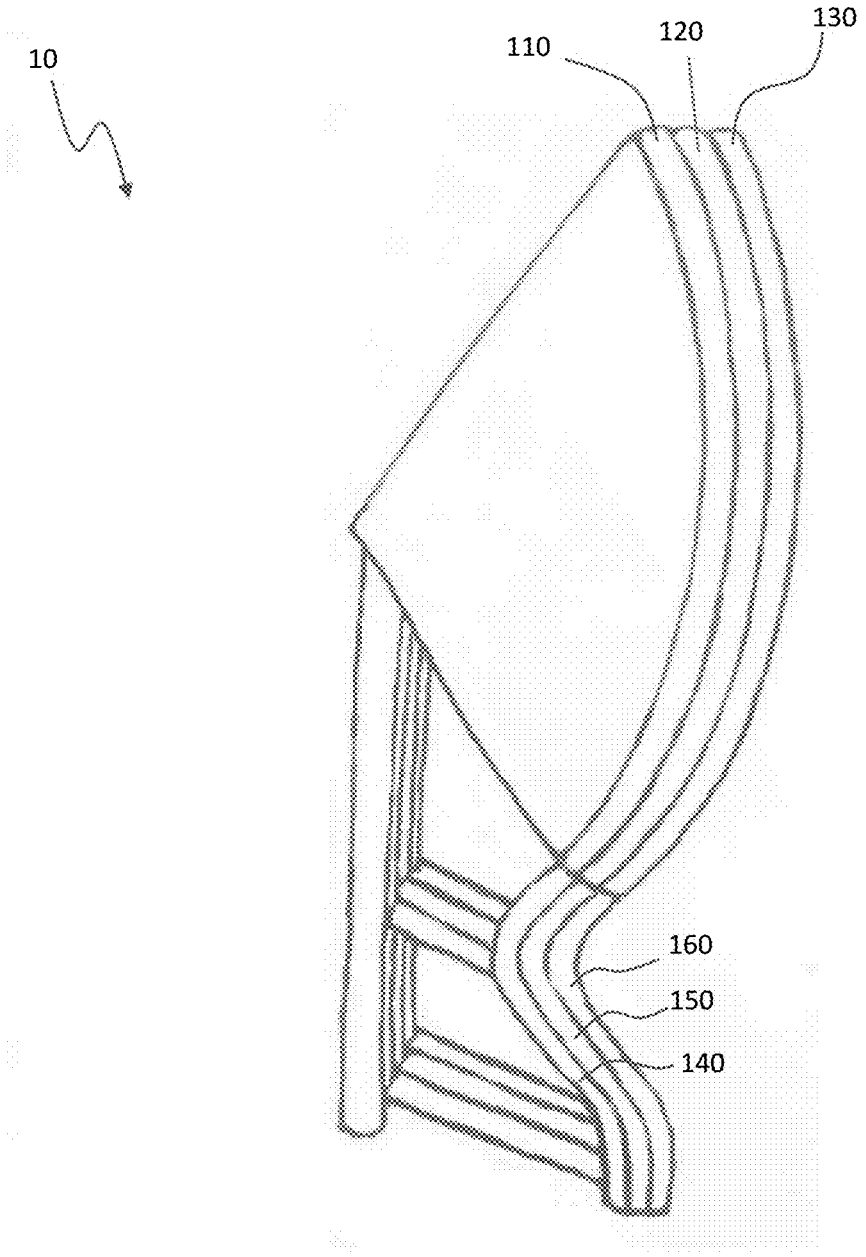
FIG. 2A is a perspective front view of a table in a storage condition according to some embodiments of the present invention.
Figure 3:
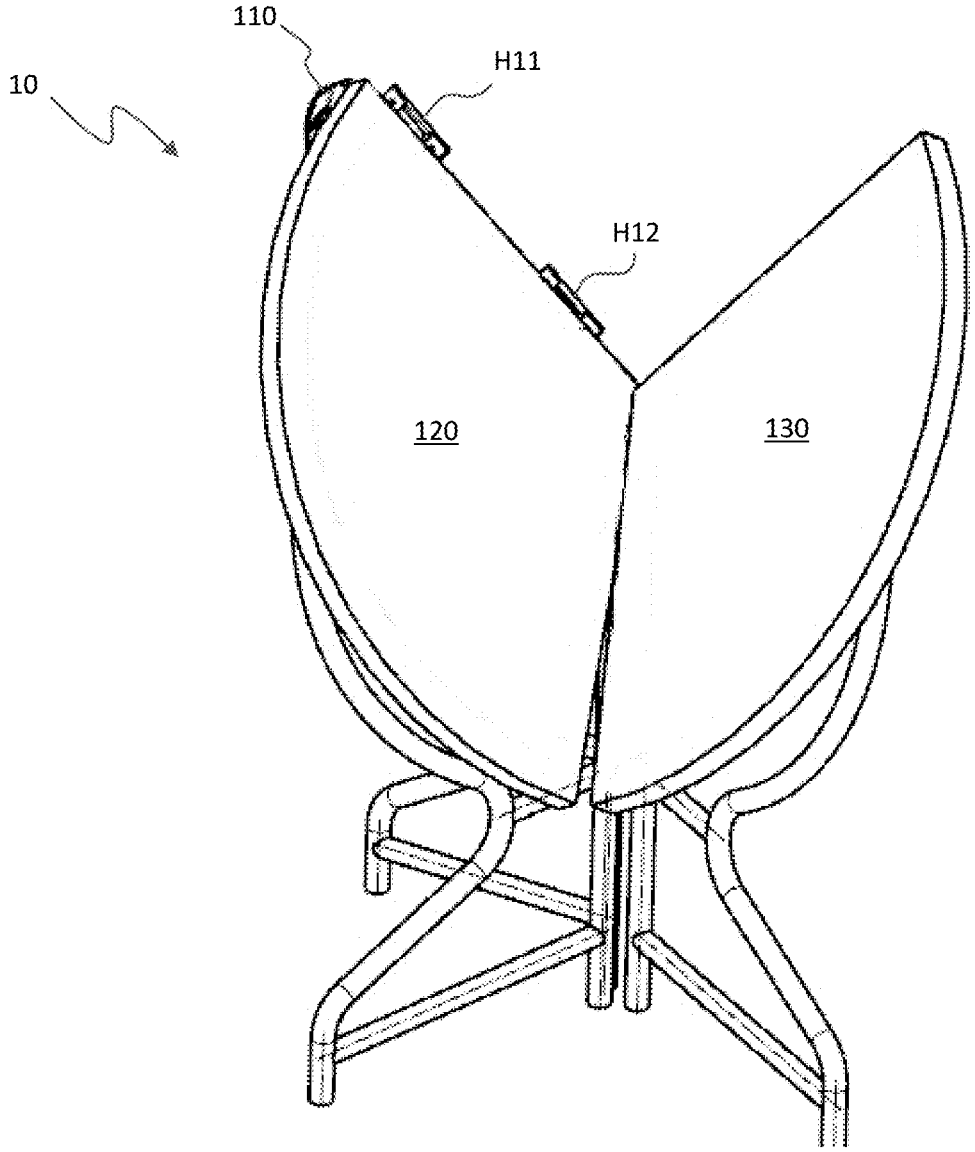
FIG. 3 depicts a table as illustrated in FIG. 1 that is in the process of being folded.
Figure 4:
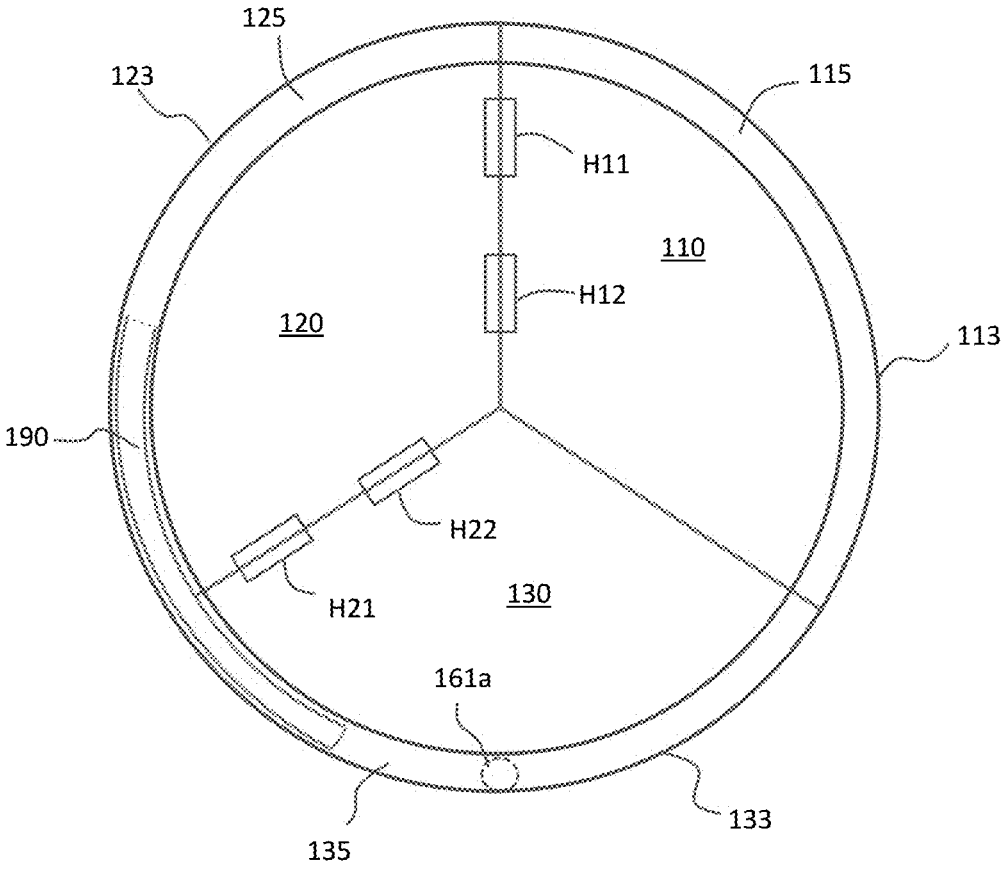
FIG. 4 is a schematic underside view of a tabletop of a table in a deployment condition according to some embodiments of the present invention.

As shown in FIG. 4, the first sector 110 and the second sector 120 are connected with hinges H1 and H12 along the edges 112 and 121 between these two sectors, which allows the first sector 110 and the second sector 120 to rotate in a first direction such that the upper side of these two sectors is rotated away from each other. The second sector 120 and the third sector 130 are connected with hinges H21 and H22 along the edges 122 and 131 between these two sectors, which allows the second sector 120 and the third sector 130 to rotate in a second, opposite direction such that underside of these two sectors is rotated away from each other. FIG. 3 shows table 10 in a transition state when it is being folded. FIG. 2A shows table 10 in the folded condition where all the three sectors are stacked, with the second sector 120 sandwiched between the first sector 110 and the third sector 130, and the second leg support 150 sandwiched between the first leg support 140 and the third leg support 160.

Figure 1B:
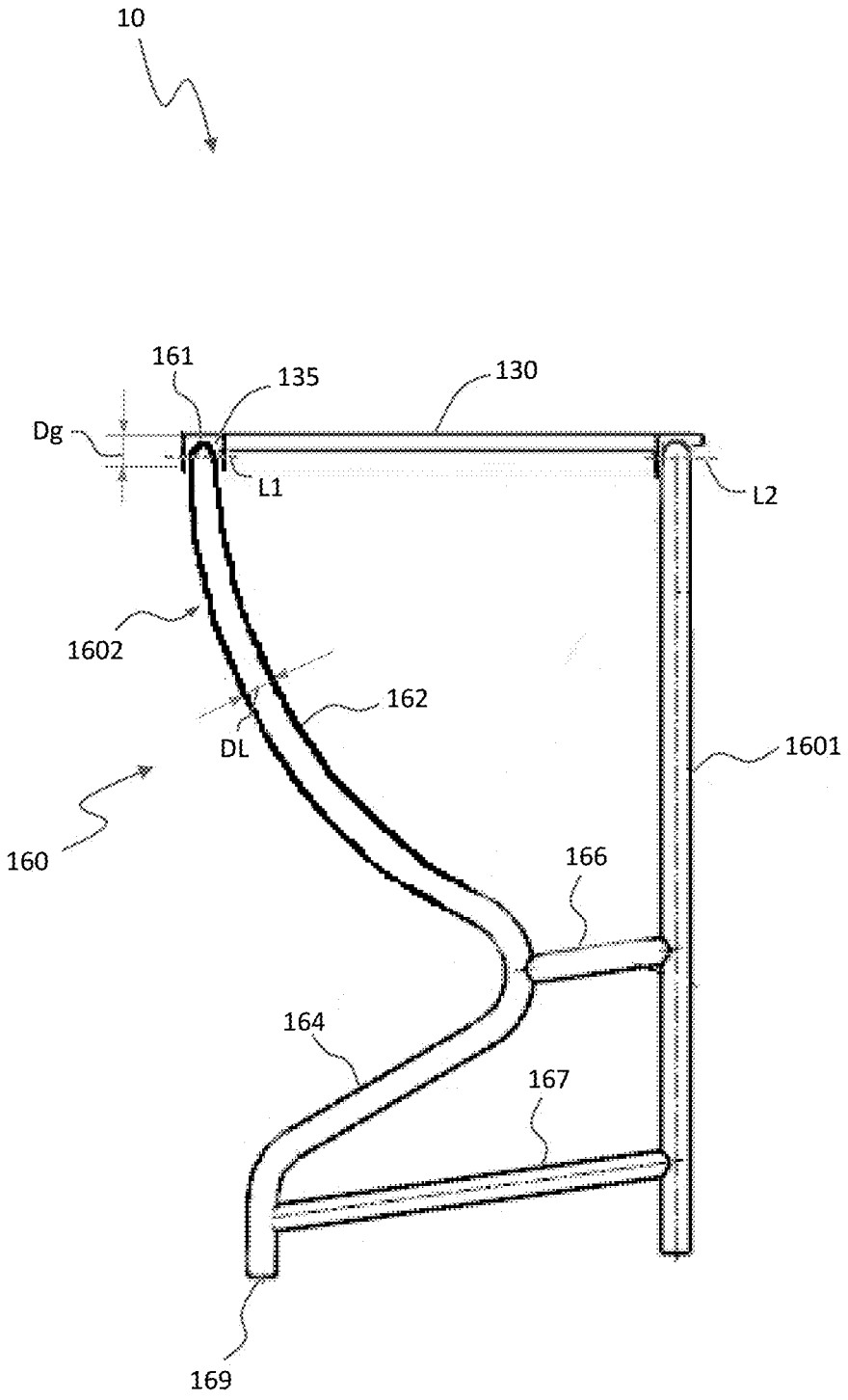
FIG. 1B is a front partial view of the table shown in FIG. 1A.
Figure 2B:
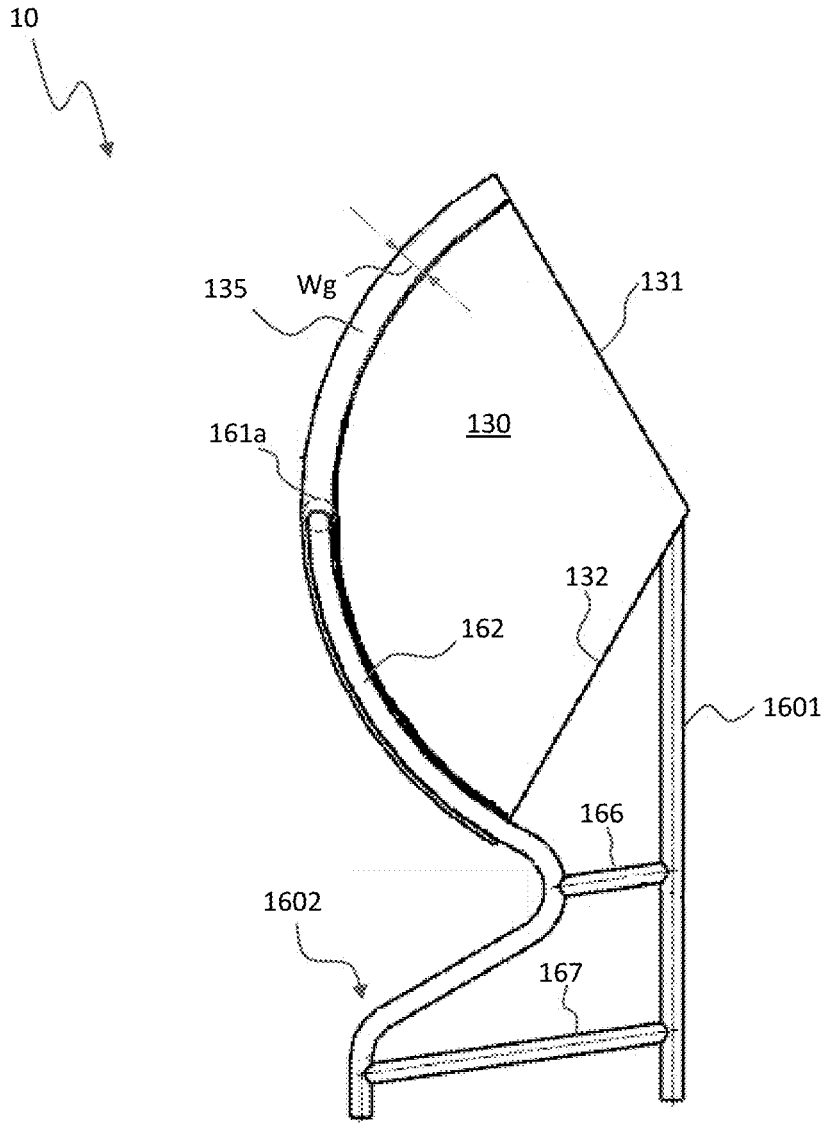
FIG. 2B is a back view of the table shown in FIG. 2A.

Also as illustrated in FIGS. 1A and 1B, the inner leg component 1601 and the outer leg component of 1602 leg support are substantially in a same plane, and the outer leg component 1602 further includes a lower portion 164 which splays downward and away from tabletop sector 130, such that the foot 169 of the outer leg component 1602 is spaced with a good distance apart from the inner leg component 1601 so as to afford proper stability of the table during use and prevent it from tipping.

In some embodiments, each of the leg supports includes one or more connecting members linking the inner leg component and outer leg component thereof. As illustrated in FIGS. 1A and 1B, connecting members 166 and 167 link the inner leg component 1601 and the outer leg component 1602. Both of connecting members 166 and 167 can be substantially parallel with the ground when the table is in the deployment state. The connecting member 166 is connected at a transition zone between the upper portion 162 and the lower portion 164 of the outer leg component 1602 where the horizontal distance between the inner leg component 1601 and the outer leg component 1602 reaches a minimum. The connecting member 167 connects the inner leg component and the outer leg component near the bottom of the leg support.

Also as shown in FIG. 4, table 10 can further include a curved bar 190 shaped and dimensioned to be inserted into and frictionally engaging the grooves of neighboring sectors, e.g., 125 and 135 of two adjacent sectors 120 and 130 when the table is in the deployment condition. This way, the bar 190 offers additional support and stability for the tabletop in the deployment condition such that the two sectors supported by the bar do not inadvertently fold against each other upon external force.

Table 10 can further include a latch mechanism to couple adjacent edges of two sectors along their respective periphery. For example, and as shown in FIG. 5, the latch mechanism 170 can be configured to couple adjacent edges of the first sector and of the third sector when the table is in the deployment condition.

Figure 5:
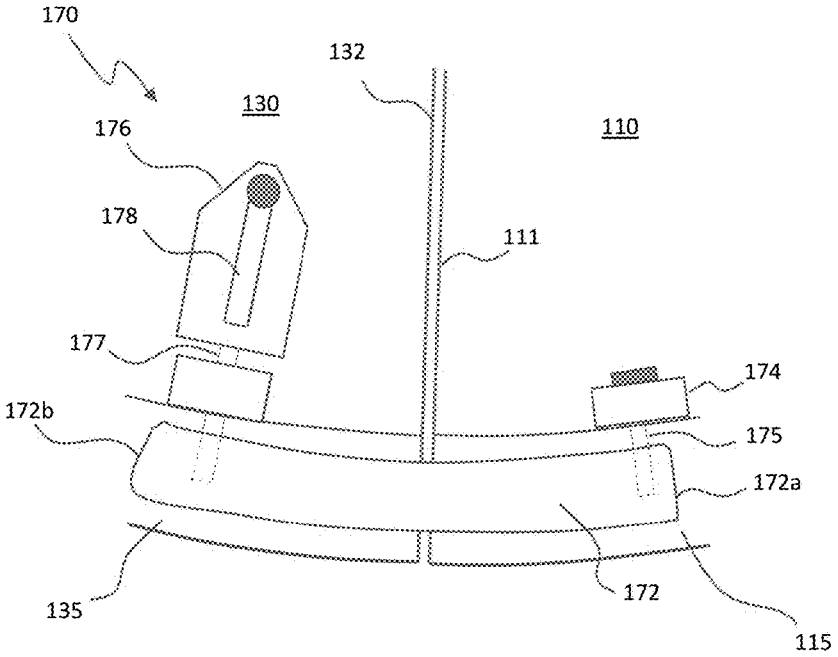
FIG. 5 is an underside view of a tabletop of a table which includes a latch mechanism according to some embodiments of the present invention.

FIG. 5 shows the latch mechanism 170 at its engaged state. The latch mechanism 170 includes a latch bar 172, a fixture 174, a shaft 175 extending from the fixture 174 and into a proximal end 172*a* of the latch bar 172 such that the latch bar 172 can rotate along the shaft 175. At this state, the latch bar 172 spans the grooves 115 and 135 of adjacent sectors 110 and 130. The latch mechanism 170 further includes a movable tab 176 and a bolt 177 extending outward from the tab 176. In this state, the tab 176 has been pushed toward the groove 135 such that the bolt 177 is inserted into the latch bar 172 near a distal end 172*b*. Moving the tab 176 away from the latch bar 172 along slot 178 can withdraw the bolt 177 from inside the latch bar 172, thereby disengaging the latch mechanism and letting free the latch bar 172, which can be rotated away along shaft 175 such that the entirety of the latch bar 172 can be accommodated within the groove 115 of the first sector 110.

The latch mechanism discussed above can be used to lock the two free edges 111 and 132 (which are not connected) to prevent the relative movement of the first sector 110 and the third sector 130 when the table is in the deployment condition. Alternatively, it can also be used to couple and lock the first sector with the second sector, or couple and lock the second sector with the third sector.

Figure 6:
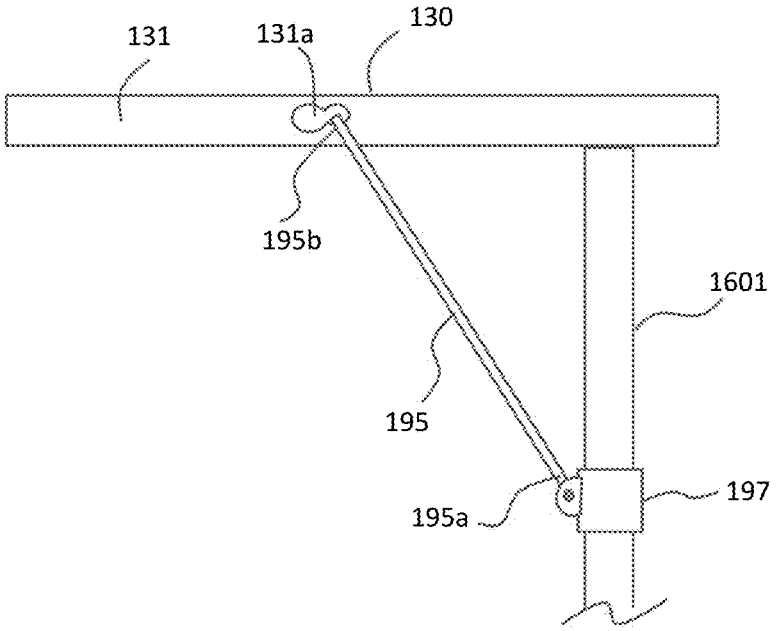
FIG. 6 is a schematic partial view of a tabletop sector of a table including a reinforcing brace connected between a leg component and the tabletop according to some embodiments of the present invention.

As shown in FIG. 6, table 10 can also include a reinforcing brace 195, which has a first end 195*a* and a second end 195*b*. The first end 195*a* is connected to a bracket 197 which is engaged with an inner leg component 1601 associated with sector 130 of the tabletop, and the second end 195*b* is connected to edge 131 of sector 130. To make the connection between the second end 195*b* of the brace and the edge 131, 195*b* can include a connector portion which can be fitted into a hole 131*a* on the edge 131. In this way, when the table is to be put into storage condition from the deployment condition, the end 195*b* of the brace can be easily detached from the edge 131. For the connection between the end 195*a* of the brace with the bracket 197, 195*a* can include a hole through which a bolt of the bracket 197 can pass. The bracket 197 can be fastened using a bolt and nut, and can slidably engage the inner leg component 1601 on different positions.

Figure 7:
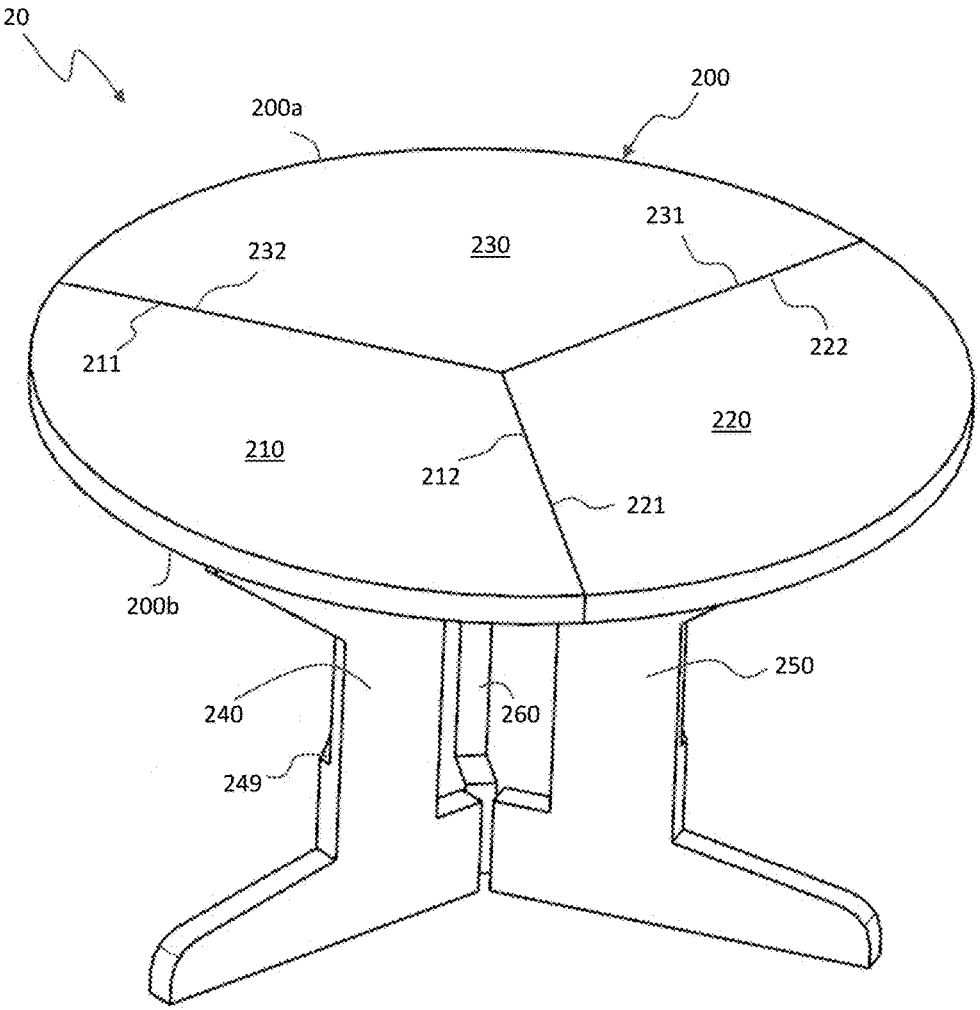
FIG. 7 is a perspective view of a table in a deployment condition according to some embodiments of the present invention.
Figure 8A:
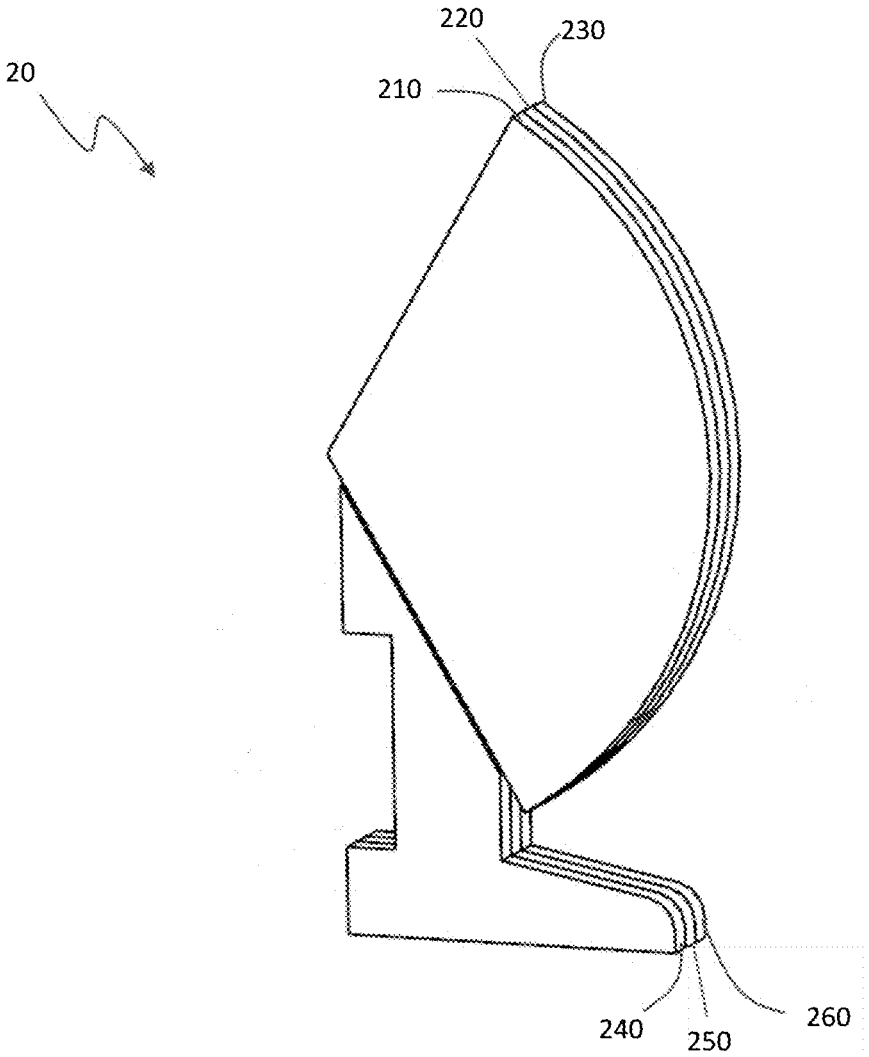
FIG. 8A is a perspective front view of a table in a storage condition according to some embodiments of the present invention.
Figure 8B:
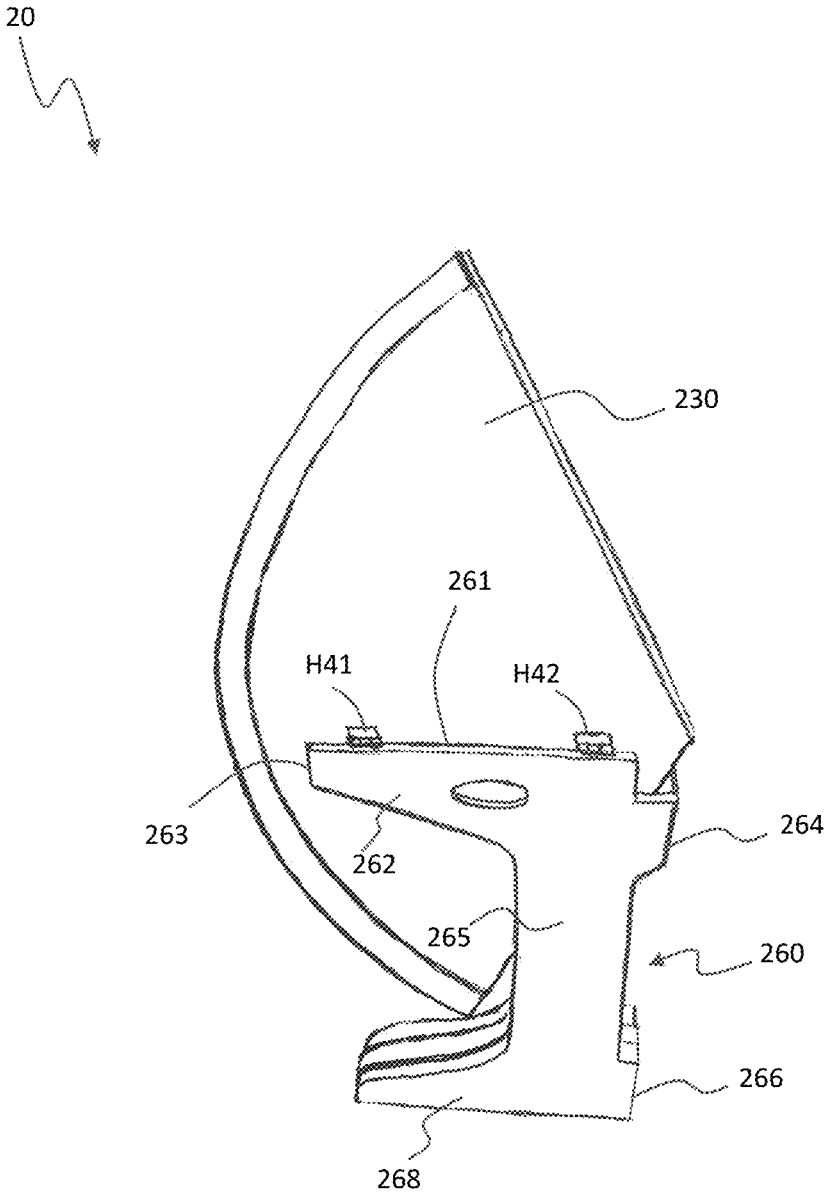
FIG. 8B is a perspective back view of a table in a storage condition according to some embodiments of the present invention.
Figure 9:
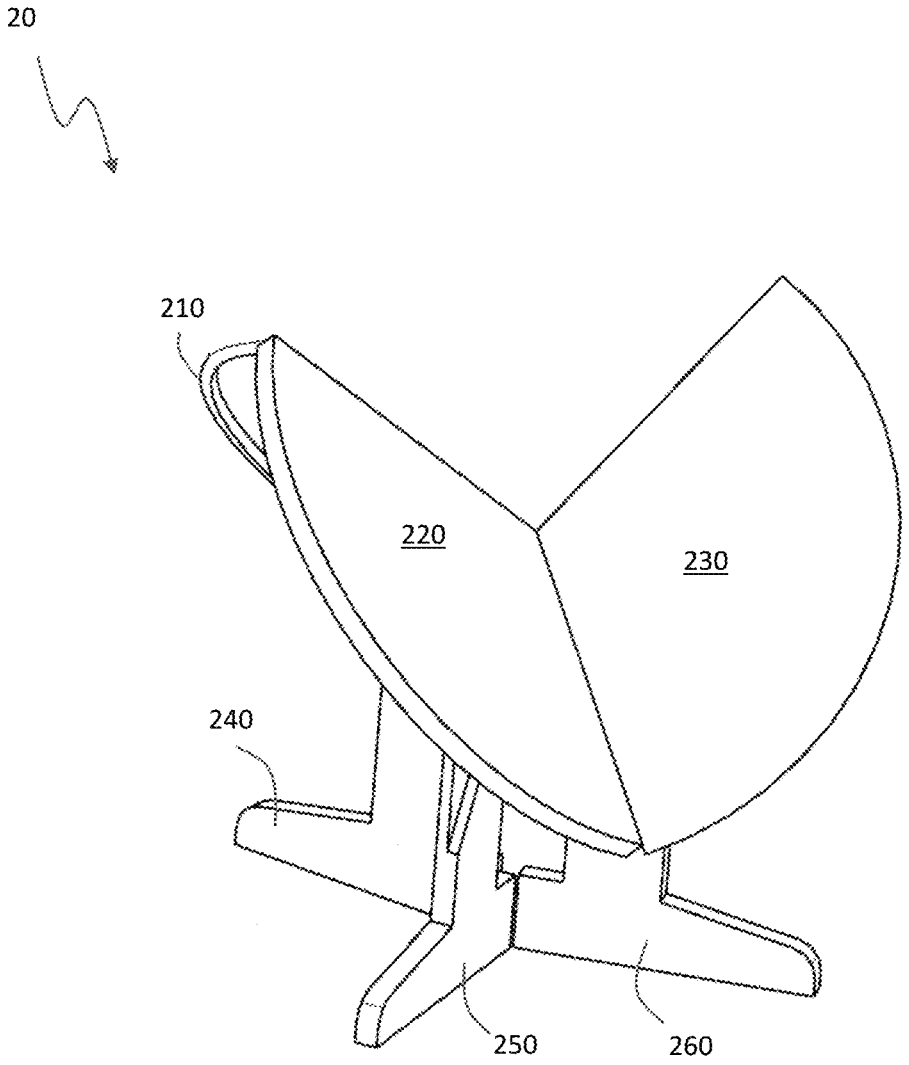
FIG. 9 depicts a table as illustrated in FIG. 7 that is in the process of being folded.

In another aspect, the present invention provides an alternative design of a foldable table, which are generally illustrated in connection with FIGS. 7, 8A-8B, 9, 10A, 10B and 11, where like reference numerals denote like elements. As illustrated in FIGS. 7 and 8A-8B, like the first design, this design of the table 20 also has a deployment condition (shown in FIG. 7) and a folded condition (shown in FIG. 8A/8B), and includes a tabletop 200 having an upper side 200*a* and an underside 200*b*, and consisting of three equal-sized sectors 210, 220, 230, each including two side edges (211, 212), (221, 222), (231, 232), respectively, and a periphery 213, 223, 233, respectively. The first sector 211 and the second sector 212 are rotatably connected at adjacent side edges (212, 221) between the first sector 210 and the second sector 220, the second sector 220 and the third sector 230 are rotatably connected at two adjacent edges (222, 231) between the second sector 220 and the third sector 230. These connections can be accomplished in a similar way as in the first design, e.g., by hinges (as illustrated in FIGS. 3 and 4). The three sectors 210, 220, 230 form a round flat tabletop surface when the table is in the deployment condition (see FIG. 7), and form a stacked configuration when the table is in the folded condition (FIGS. 8A/8B), where the second sector 220 is sandwiched between the first sector 210 and the third sector 230 the second leg support 250 is sandwiched between the first leg support 240 and the third leg support 260.

This second design of the foldable table includes a leg support 240, 250, 260 for each of the tabletop sectors 210, 220, 230, respectively. Each leg support 240, 250, 260 takes a generally planar profile. As illustrated in FIG. 8B, and take leg support 260 as an example, a leg support can include a shoulder portion 262, a neck portion 264, a foot portion 268, a heel portion 266, and a body portion 265 between the shoulder portion and the foot portion. A top edge 261 of the shoulder portion 262 is hingedly connected to the underside of sector 230 via hinges H41 and H42 to allow rotation of sector 230 about the top edge 261, so as to fold the tabletop into the storage condition.

Figure 10A:
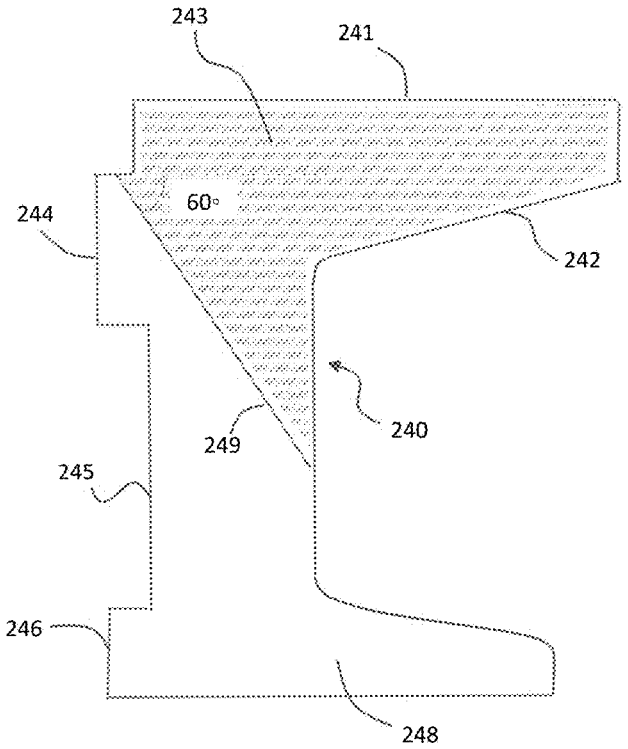
FIG. 10A is a schematic side view of a leg support of a table according to some embodiments of the present invention.
Figure 10B:
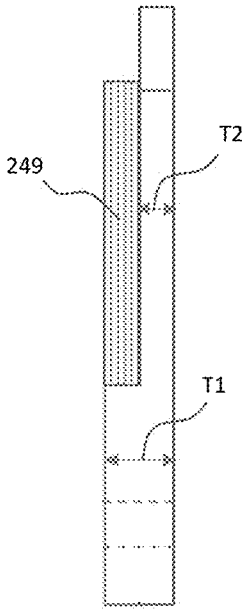
FIG. 10B is a right side schematic view of the leg component shown in FIG. 10A.

As shown in FIGS. 7, 10A and 10B, at least one leg support, e.g., 240, of table 20 has a depressed area 243 (shaded area in FIG. 10A) located at an upper portion of the leg support and having a reduced thickness (T2, see FIG. 10B) than that of the lower part of the leg support (T1, FIG. 10B). This area 243 is configured to accommodate a portion of sector associated with the leg support 240, and is defined from the top edge 241 of leg support 240 to a slanted step 249 at its lower bound. The slanted step 249 can engage the side edge 221 of the sector 220 when the table is put in the folded condition. For example, the slanted step 249 can form approximately 60-degree angle with the tabletop (or the top edge 241 of leg support 240), such that when the sector 210 is completely folded, the side edge 221 can rest snugly on the slanted step 249 with a maximum contact area, which allows for additional support of the weight of the sector by the slanted step 249. As other sectors are connected on side edges with sector 220, when the tabletop are folded, the slanted step 249 can help support the entire tabletop. Other leg supports 250 and 260 can likewise include the depressed area and slanted step as that of leg support 240.

Figure 11:
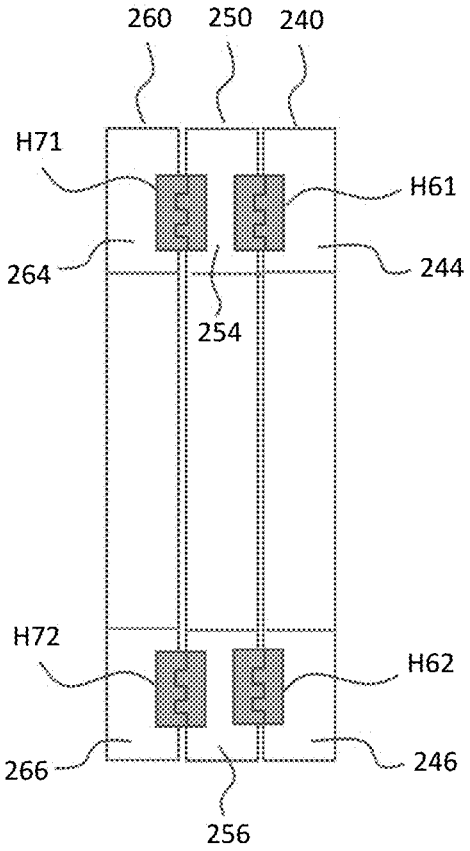
FIG. 11 is a schematic back view of the leg supports of a table according to some embodiments of the present invention.

The leg supports 240, 250, 260 can be hingedly joined for the stability of ease of handling of the table 20. Referring to FIG. 11, which illustrates a back view of the leg supports when the table 20 is in the storage condition, the leg support 240 is hingedly connected to leg support 250 via hinges H61 and H62, the leg support 250 hingedly connected to the leg support 260 via hinges H71 and H72. Hinges H61 and H71 connect the leg supports 240, 250, and 260 at their respective neck portions 244, 254, and 264; hinges H62 and H72 connect the leg supports 240, 250, and 260 at their respective heel portions 246, 256, and 266. Leg support 250 is stacked between the leg support 240 and leg support 260.

The tabletop as well as the leg supports for table 20 can be made from wood or plastic, or other material as needed or desired. For ease of handling, the foot portion of each leg support can include a wheel.

The description herein merely illustrates the principles of the disclosed subject matter. Various modifications and alterations to the described embodiments will be apparent to those skilled in the art in view of the teachings herein. Further, it should be noted that the language used herein has been principally selected for readability and instructional purposes. Accordingly, the disclosure herein is intended to be illustrative, but not limiting, of the scope of the disclosed subject matter.

What is claimed is:

1. A foldable table having a deployment condition and a folded condition, comprising:

a tabletop consisting of three equal-sized sectors, each sector having an upper side and an underside and including two side edges, wherein the first sector and the second sector are rotatably connected at the two adjacent side edges between the first sector and the second sector, the second sector and the third sector are rotatably connected at the two adjacent edges between the second sector and the third sector, whereby the three sectors form a round flat tabletop surface when the table is in the deployment condition, and form a stacked configuration when the table is in the folded condition;

three leg supports, each associated with one of the three sectors, respectively, each leg support taking a generally planar profile and including a shoulder portion having a top edge hingedly connected to the underside of the associated sector to allow rotation of the sector about the top edge, and wherein at least one leg support has a depressed area configured to accommodate a portion of the associated sector when the table is in the folded condition.

2. The foldable table of claim 1, wherein the depressed area includes a slanted step configured to engage a side edge of the associated sector when the table is in the folded condition.

3. The foldable table of claim 1, wherein the first sector and the second sector are rotatable in a first direction, the second sector and the third sector are rotatably in a second, opposite direction, such that when the table is in the folded condition, the second sector is stacked between the first sector and the third sector.

4. The foldable table of claim 1, wherein the leg support for the first sector is hingedly connected to the leg support for the second sector, the leg support for the second sector is hingedly connected to the leg support for the third sector, and wherein when the table is in the folded condition, the leg support for the second sector is stacked between the leg support for the first sector and the leg support for the third sector.

* * * * *